US006537393B2

(12) United States Patent
Farr et al.

(10) Patent No.: US 6,537,393 B2
(45) Date of Patent: Mar. 25, 2003

(54) HIGH TEMPERATURE THERMAL PROCESSING ALLOY

(75) Inventors: Norman C. Farr, Hereford (GB); Gaylord D. Smith, Huntington, WV (US)

(73) Assignee: INCO Alloys International, Inc., Huntington, WV (US)

( * ) Notice: Subject to any disclaimer, the term of this patent is extended or adjusted under 35 U.S.C. 154(b) by 0 days.

(21) Appl. No.: 09/914,514

(22) PCT Filed: Jan. 24, 2001

(86) PCT No.: PCT/US01/02369

§ 371 (c)(1),
(2), (4) Date: Aug. 29, 2001

(87) PCT Pub. No.: WO01/53551

PCT Pub. Date: Jul. 26, 2001

(65) Prior Publication Data

US 2002/0185197 A1 Dec. 12, 2002

Related U.S. Application Data

(60) Provisional application No. 60/177,861, filed on Jan. 24, 2000.

(51) Int. Cl.[7] ..... C22C 19/05

(52) U.S. Cl. ..... 148/428; 420/443; 420/448; 420/449

(58) Field of Search ..... 420/443, 448, 420/449; 148/428

(56) References Cited

U.S. PATENT DOCUMENTS

| | | | |
|---|---|---|---|
| 2,661,285 | A | 12/1953 | Gorschalki |
| 2,691,690 | A | 10/1954 | Poch et al. |
| 3,303,531 | A | 2/1967 | Ogden |
| 3,582,616 | A | 6/1971 | Wrob |
| 3,592,061 | A | 7/1971 | Schwedland et al. |
| 3,876,475 | A | 4/1975 | Ramqvist |
| 3,916,497 | A | 11/1975 | Doi et al. |
| 4,153,455 | A | 5/1979 | Eiselstein et al. |
| 4,195,987 | A | 4/1980 | Herchenroeder |
| 4,227,925 | A | 10/1980 | Hosoi et al. |
| 4,400,209 | A | 8/1983 | Kudo et al. |
| 4,400,211 | A | 8/1983 | Kudo et al. |
| 4,749,546 | A | 6/1988 | Burley |
| 4,834,807 | A | 5/1989 | Burley |
| 4,844,864 | A | 7/1989 | Frank |
| 4,909,855 | A | 3/1990 | Burley |
| 5,010,316 | A | 4/1991 | Burley |
| 5,030,294 | A | 7/1991 | Burley |
| 5,043,023 | A | 8/1991 | Bentley |
| 5,063,023 | A | 11/1991 | Sridhar |
| 5,338,616 | A | 8/1994 | Ishii et al. |
| 5,424,029 | A | 6/1995 | Kennedy et al. |
| 5,529,642 | A | 6/1996 | Sugahara et al. |

FOREIGN PATENT DOCUMENTS

| | | | |
|---|---|---|---|
| JP | (1980) 55-002773 | A | 1/1980 |
| JP | (1981) 56-035737 | A | 4/1981 |
| JP | (1986) 61-288041 | A | 12/1986 |

*Primary Examiner*—Roy King
*Assistant Examiner*—Harry D. Wilkins, III
(74) *Attorney, Agent, or Firm*—Robert F. Dropkin, Esq.; Webb Ziesenheim Logsdon Orkin & Hanson, P.C.

(57) ABSTRACT

A nickel base alloy for high temperature thermal processing hardware requiring ultra-low spallation and metal loss rates in oxidizing and nitriding atmospheres for use in wire mesh belting, thermocouple sheathing, resistive heating elements, heat sensing cables, furnace internals and like hardware. The compositional range of the alloy is 15.0–23.0 % Cr, 0.5–2.0 % Si, 0.0–4.0% Mo, 0.0–1.2 % Nb, 0.0–3.0 % Fe, 0.0–0.5 % Ti, 0.0–0.5 % Al, 0.0–0.3 % Mn, 0.0–0.1 % Zr, 0.0–0.06 % Ce, 0.005–0.025 % Mg, 0.0005–0.005 % B, 0.005–0.3 % C, 0.0–20.0 % Co, balance Ni. The alloy possesses a high degree of hot and cold workability, phase stability and strength retention at elevated temperatures.

8 Claims, 6 Drawing Sheets

Oxidation (Air + 5% $H_2O$ Vapor) at 1200°C
Alloy 6
Alloy HX
310
Alloy 600
Alloy B
50
0
-50
-100
-150
-200
-250
Mass Change, mg/cm$^2$
0
200
400
600
800
1000
1200
Exposure Time, Hours Oxidation (Air + 5% H2O Vapor) at 1250°C Oxidation (Air + 5% H2O Vapor) at 1300°C Mass Change after Cyclic Exposure
(2-Hour Cycles) in $O_2$ at 1200°C Mass Change after Exposure in $N_2$-5%$H_2$ at 2050°F Mass Change after Exposure in $N_2$-5%$H_2$ at 1177°C (2150°F)

HIGH TEMPERATURE THERMAL PROCESSING ALLOY

This application claims benefit of U.S. provisional application 60/177,861 filed Jan. 24, 2000.

BACKGROUND OF THE INVENTION

1. Field of the Invention

The present invention relates generally to high temperature alloys and, more particularly, to nickel-base alloys which are suitable for use in high temperature oxidizing and nitrogen bearing atmospheres.

2. Description of the Related Art

Performance requirements for thermal processing equipment and their components are dramatically increasing as industry strives for increasing productivity, cost savings, longer service lives and greater levels of reliability and performance. These requirements have motivated alloy manufacturers to upgrade the corrosion resistance, stability and strength of their alloys used in thermal processing applications while at the same time improving hot and cold workability in order to improve product yield and reduce cost to the consuming industry. These demands are particularly strong in a number of areas, including the powder metallurgy and silicon chip industries, the manufacture of thermocouple sheathing and protection tubes and in the resistive heating element manufacture. Wire mesh belting is an example of the type of application for which this alloy range is desired. In the power metallurgy (P/M) industry, metal powder is compacted in dies in the desired shape of a component and then sintered by exposing the compacted component in a controlled atmosphere at high temperature for a period of time. It is well-known that iron powders can be sintered to higher strength when sintered at increasingly higher temperatures. In addition, certain materials, notably stainless steels, requireextremely high temperatures (about 1200° C.) to achieve useful corrosion and strength properties. These higher temperatures make the commonly used wire mesh belting alloy (Type 314 stainless steel) unacceptable for use due to lack of strength and high temperature nitridation resistance. A similar situation exists in the annealing of silicon chips at these temperatures, where spallation of the wire mesh belting must be as low as possible in order not to contaminate the silicon chips. Again, the spallation rate of commercial wire mesh belting alloys in this annealing atmosphere is deemed excessive and requires a marked improvement in corrosion resistance without loss of strength.

Commercial alloys commonly used as the sheathing alloy of mineral-insulated metal-sheathed (MIMS) thermocouples contain elements that ultimately at elevated temperatures degrade thermocouple (both K and N Type) performance by diffusing from the sheathing through the insulating mineral and reacting with the thermocouples to cause EMF drift. Certain alloys designed to resist this type of degradation while retaining adequate oxidation corrosion resistance have been found to be extremely difficult to manufacture in good yield.

SUMMARY OF THE INVENTION

Surprisingly, it has been discovered that the necessarily low spallation and metal loss rates, strength, stability and fabricability for the above industry requirements can be obtained by an alloy of the present invention having the following composition, in % by weight, about: 15.0–23.0% Cr, 0.5–2.0% Si, 0.0–4.0% Mo, 0.0–1.2% Nb, 0.0–3.0% Fe, 0.0–0.5% Ti, 0.0–0.5% Al, 0.0–0.3% Mn, 0.0–0.1% Zr, 0.0–0.06% Ce, 0.005–0.025% Mg, 0.0005–0.005% B, 0.005–0.3% C, 0.0–20.0% Co, balance Ni. Maximum strength, spallation and metal loss rates, and resistance to degradation of thermocouples can be obtained by restricting the alloy range further to a more preferred range consisting essentially of about: 21.0–23.0% Cr, 1.3–1.5% Si, 2.5–3.5% Mo, 0.0–0.2% Nb, 0.0–1.0% Fe, 0.0–0.1% Ti, 0.0–0.1% Al, 0.0–0.1% Mn, 0.0–0.1% Zr, 0.015–0.035% Ce, 0.005–0.025% Mg, 0.0005–0.005% B, 0.005–0.05% C, balance Ni. As used hereinafter, all % values, unless otherwise noted, are % by weight.

Normally, the above-described combination of elements would not be expected to perform all the aboveiscussed requirements within a single composition. However, it has been discovered that by using trace amounts of certain elements (Zr, Ce and Mg), the negative effects of certain other elements (Mo, Nb, Fe, Mn and Ti) can be ameliorated, and by restricting other elements to critically essential levels (Si, Al, B and C), their benefit can be utilized without degrading other properties. These balanced levels must be incorporated within a thermodynamically stable matrix which can best be found within the Ni—Cr system when elevated temperature, strength and corrosion resistant properties must be maintained. Too often, striving for maximized strength or corrosion resistance results in alloys that cannot be commercially made economically or in large quantity on commonly used alloy manufacturing equipment. This impediment has been overcome by the alloy range of the present invention. The selection of each elemental alloying range can be rationalized in terms of the function each element is expected to perform within the compositional range of the invention. This rationale is explained in greater detail hereinafter.

DETAILED DESCRIPTION OF THE IVENTION

Chromium (Cr) is an essential element in the alloy range of the present invention because it assures development of a protective scale which confers both oxidation, nitridation and sulfidation resistance. In conjunction with the trace element amounts of Zr, Ce, Mg and Si, the protective nature of this protective scale is even more enhanced and made useful to higher temperatures. These elements (Zr, Ce, Mg and Si) function to enhance scale adhesion, density and resistance to decomposition. The minimum level of Cr is chosen to assure a-chromia formation at temperatures of 1,000° C. and above. This minimum effective level of Cr was foundto be about 15%. Higher Cr levels formed α-chromia more rapidly, i.e., within minutes at temperature but did not change the nature of the α-chromia scale. The maximum Cr level of 23% was made manifest by the lack of further benefit with increasing Cr levels which reduced stability and workability. Absorption and interaction of nitrogen with Cr in typical sintering furnace atmospheres, leading to possible harnfuil alloy embrittlement, further contributed to restricting the Cr level to 23%.

Silicon (Si) is an essential element in the alloy range of this invention because it ultimately forms an enhancing silica (SiO) layer beneath the α-chromia scale to further improve corrosion resistance in oxidizing and carburizing environments. This is accomplished by the blocking action that the silica layer contributes to inhibiting ingress of the molecules or ions of the atmosphere and the egress of cations of the alloy. Levels of Si between 0.5 and 2.0% and more preferably between 1.3 and 1.5% are effective in this role. Si contents above 2% lead to appreciable metal loss in the nitrogen-based atmospheres principally used for P/M sintering. Table 6 shows the effect of Si content on metal loss in a typical PIM sintering atmosphere. The alloys of Table 6 are all commercial alloy compositions.

Figure 4:
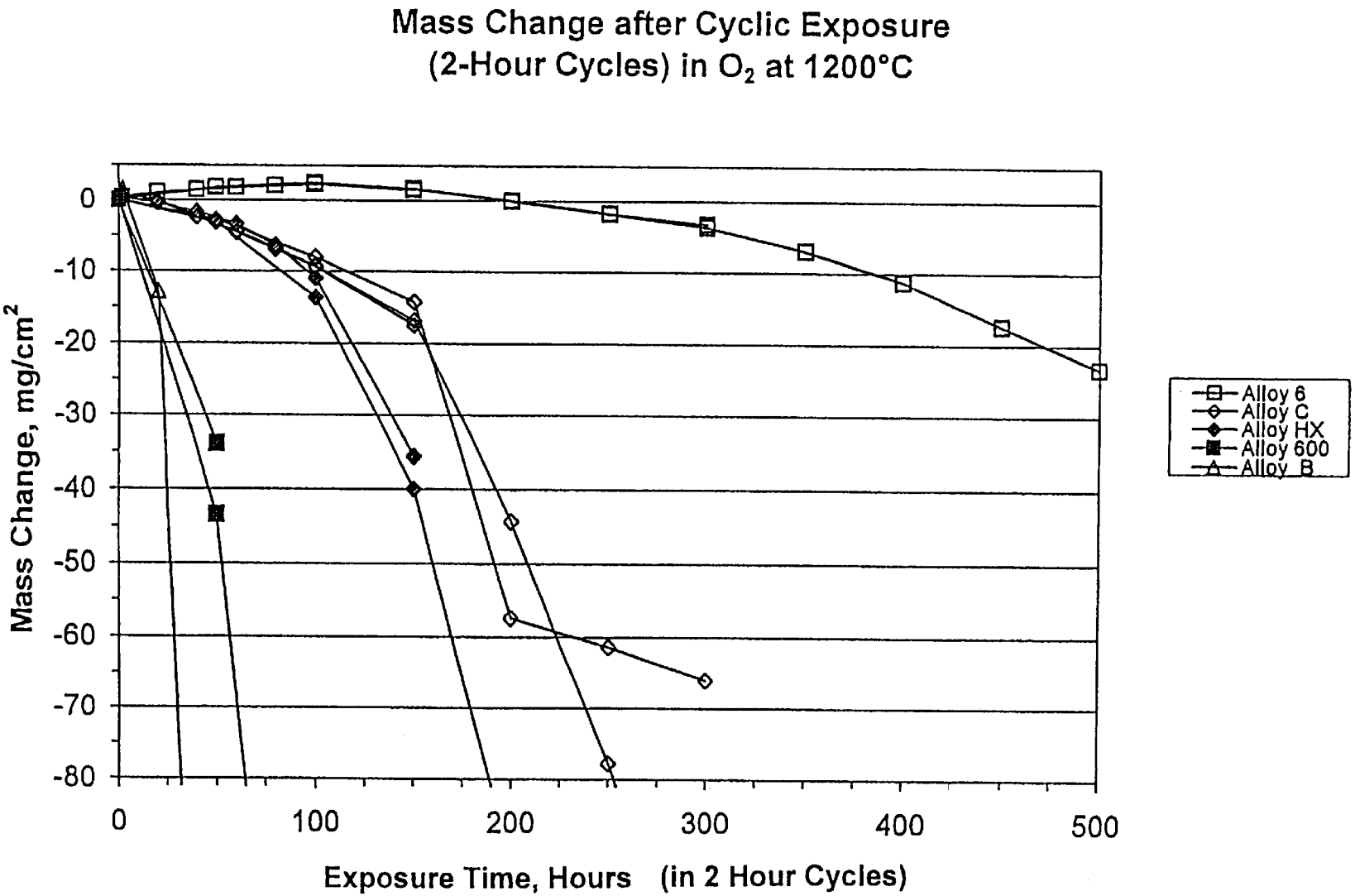
FIG. 4 is a graph of mass change vs. time after cyclic exposure to oxygen in two hour cycles at 1200° C., covering several alloys of the present invention.

Molybdenum (Mo) and niobium (Nb), along with Cr to a lesser degree, are solid solution strengthening alloys within a Ni matrix. These elements are also carbide-forming elements which serve an additional role in the alloy range of this invention of aiding grain size control during annealing and in subsequent service environments. However, in excessive amounts, Cr, Mo and Nb can detract from protective scale performance as is shown in FIG. 4, which changes the spallation resistance of an alloy of this invention under cyclic oxidation conditions to 250 cycles at 1200° C. in air +5% $H_2O$ vapor (cycle: 2 hours at 1200° C., 10 minutes cool to room temperature) as compared to other commercial heat-resistant alloys. Alloy HX shows the detrimental effect of excessive Mo (and Fe), Incotherm alloy C shows the detrimental effect of additional Cr beyond 23%, and Incotherm alloy B exhibits the reduction in spallation resistance associated with increasing amounts of Nb. It is clear that minor deviations from the levels defined in this invention result in substantial loss of oxidation resistance as defined by resistance to spallation.

Iron (Fe) additions to the alloys of this patent range lower the high temperature corrosion resistance if Fe is present in excess of 3%. Less than 1% Fe is preferred for critical service. Alloys HX and 600 are two examples of commercial alloys containing excessive amounts of Fe. The poor spallation behavior of these alloys is graphically depicted in FIG. 4.

Aluminum (Al) in amounts less than 0.5% and preferably less than 0.1% may be present as a deoxidant. However, Al in amounts greater than 0.5% can lead to internal oxidation and nitridation which reduces ductility and lower thermal cycling fatigue resistance. Larger amounts of Al can also reduce workability of the alloy.

Titanium (Ti) in amounts preferably less than 0.5% and, more preferably, less than 0.1% serve to act as a grain size stabilizer. The addition of Ti in amounts greater than 0.5% has a deleterious effect on hot workability and on high temperature oxidation resistance. Ti is an alloying element that forms an oxide which is more stable than α-chromia and is prone to internally oxidize, thus leading to unwanted reduced matrix ductility.

Manganese (Mn) is a particularly detrimental element which reduces protective scale integrity. Consequently, Mn must be maintained preferably below 0.3% and more preferably below 0.1%. Mn above these levels rapidly degrades the α-chromia scale by diffusing into the scale and forming a spinel, $MnCr_2O_4$. This oxidization is significantly less protective of the matrix than is α-chromia. Mn, when contained within an alloy used as thermocouple sheathing, can also diffluse from the sheathing into the thermocouple wires and cause a harmful EMF drift.

Zirconium (Zr) in amounts less than 0.1% and boron (B) in amounts between 0.0005 and 0.005% are effective in contributing to high temperature strength and stress rupture ductility. Larger quantities of Zr and B lead to grain boundary liquation and markedly reduced hot workability. Zr in conjunction with cerium (Ce) in amounts up to about 0.06%, preferably between 0.015 and 0.035%, enhance the adhesion of the α-chromia scale. However, larger amounts of Ce dramatically embrittle the alloy range of the present invention. Magnesium (Mg) in amounts between 0.005 and 0.025% also contributes to adhesion of the α-chromia scale as well as effectively desulfurizes the alloy range of this invention. An excessive amount of Mg decidedly reduces hot workability and lowers product yield of thin strip and fine wire end product shapes. Trace amounts of lanthium (La), yttrium (Y) or misch metal may be present in the alloys of this invention as impurities or as deliberate additions to promote hot workability. However, their presence is not mandatory as is that of the Mg and preferably that of the Ce. To balance the negative effect of Mo, Nb, Fe and Ti on oxidation and spallation rates, the ratio of Zr, Ce, Mg and Si to Mo, Nb, Fe and Ti must be at least 1:16.5 and optimally closer to 1:3.8, especially when the Cr levels are in the lower portion of the 15–23% range. A ratio of (Zr+Ce+Mg+Si) to (Mo+Nb+Fe+Ti) of at least about 1:17 to about 1:0.05 is effective.

Carbon (C) should be maintained between 0.005 and 0.3%. The role of carbon is critical for grain size control in conjunction with Ti and Nb. The carbides of these elements are stable at temperatures in excess of 1000° C., the temperature range for which the alloys of the present invention were intended. The carbides not only stabilize grain size to assure preservation of fatigue properties, which are a function of grain size, but they contribute to strengthening the grain boundaries to enhance stress rupture properties.

Nickel (Ni) forms the critical matrix of the alloy and must be present in an amount preferably in excess of 68% and more preferably in excess of 72% in order to assure chemical stability, adequate high temperature strength and ductility, good workability and mninimal diffusional characteristics of the alloying elements of this invention. For wire mesh belt applications, where strength at elevated temperature can be of paramount importance, the Ni level is most preferably greater than 75%. High levels of Ni especially promote nitridation resistance.

Cobalt (Co) and Ni are often regarded as interchangeable and, in relatively limited amounts, this is true. Cobalt in amounts up to 20% may be substituted for nickel at the sacrifice of cost since Co is much more expensive than Ni. The interchange of Co for Ni is applicable to the alloys of this invention as is shown by Alloy 5. However, because of cost, the principal application of this new technology is focused on the use of Ni. EXAMPLES Developmental heats within the alloy range of the present invention were produced by vacuum induction melting 25 Kg heats using relatively pure elemental raw materials. The ingots were static cast, homogenized typically at a temperature around 1177° C. for 16 hours and hot worked into nominally 16 mm round bar and annealed at about 1200° C.

for usually five minutes. The chemical compositions of the examples of alloys contemplated by the present invention are given in Tables 1A and 2B. Comparative compositions of the commercial alloys outside the alloy range of the invention are presented in Tables 2A and 2B. Tensile properties at room temperature and 1150° C. are presented in Table 3 for the alloys of this invention and for selected alloys of the invention at 1177° C. and 1200° C. in Table 4. Comparative strength data for the commercial heat resistant alloys are given in Table 5.

Figure 1:
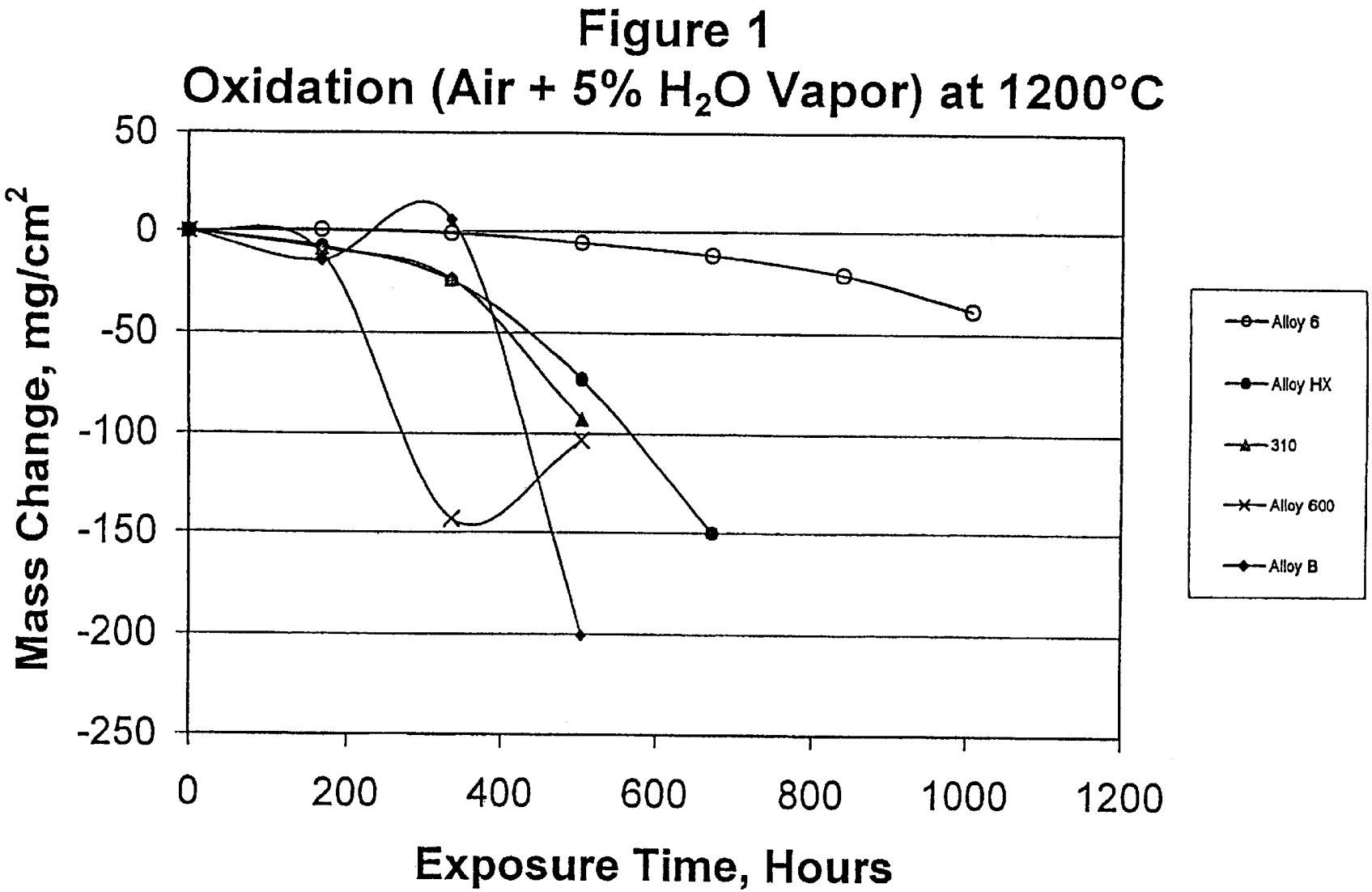
FIG. 1 is a graph of oxidation testing results comparing several alloys plotting mass change vs. exposure time in air plus 5% water vapor at 1200° C.
Figure 2:
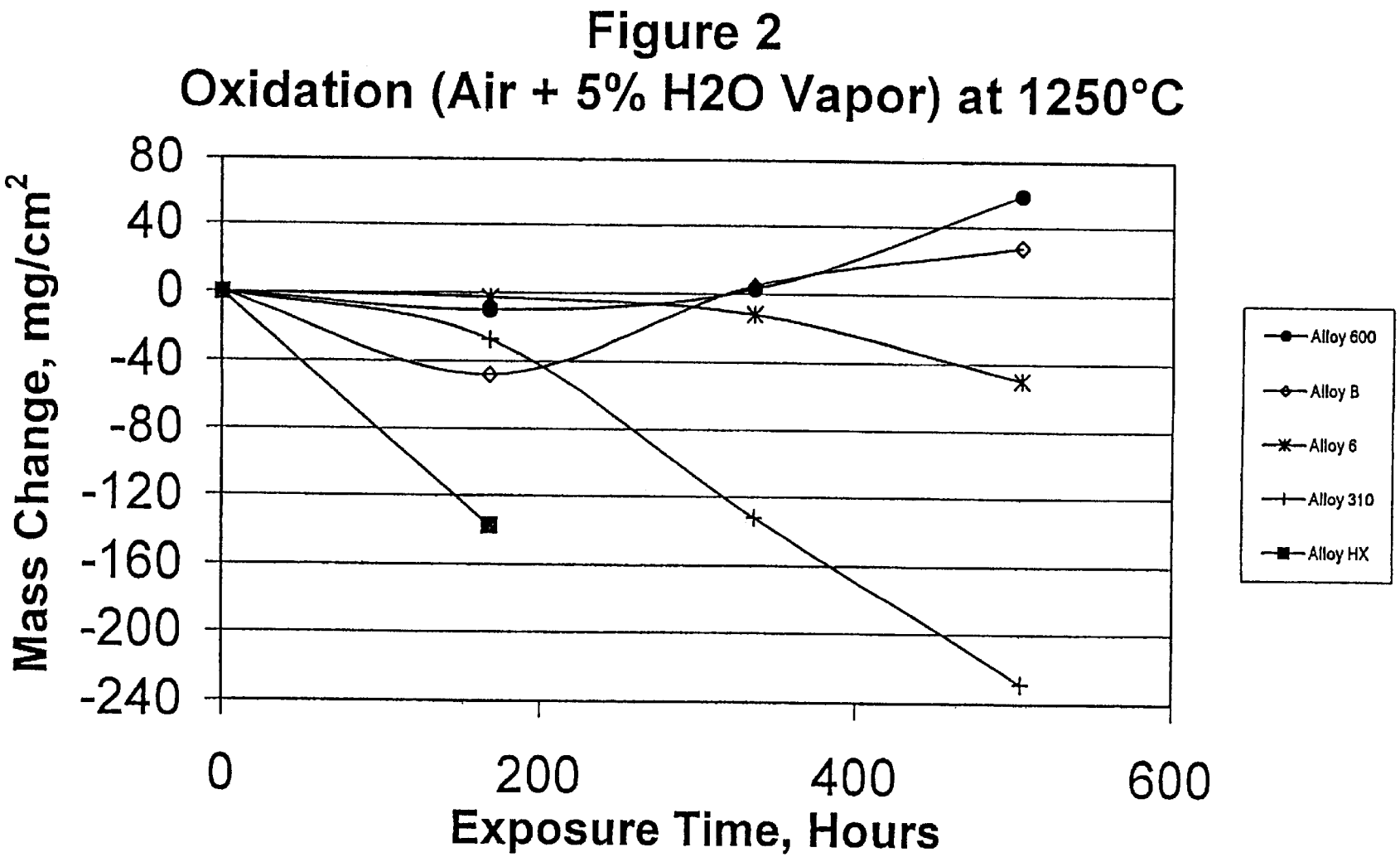
FIG. 2 is a graph similar to FIG. 1 testing the same alloys at 1250° C.
Figure 3:
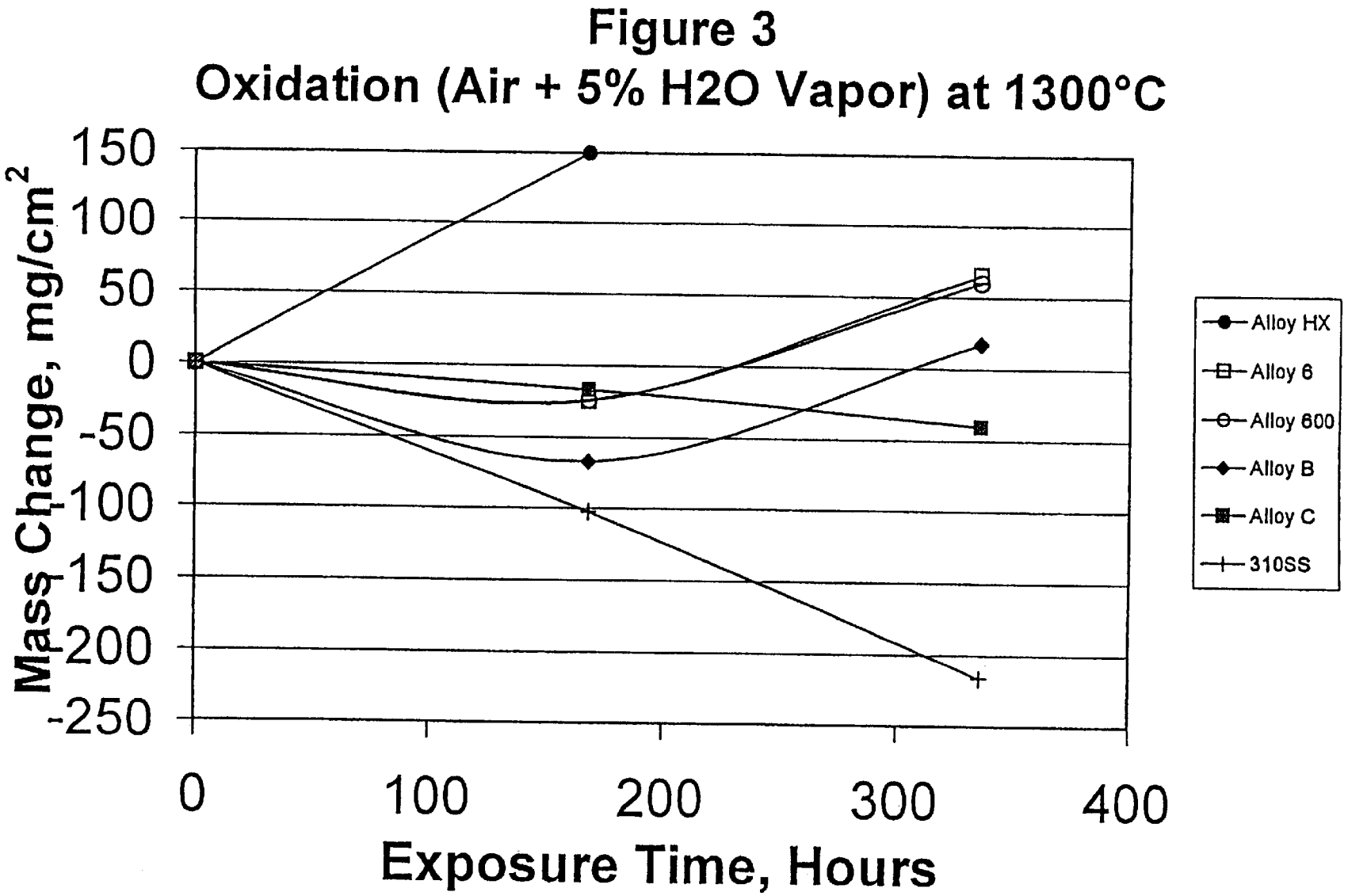
FIG. 3 is a graph similar to FIGS. 1 and 2 with the test temperature at 1300° C.

Oxidation testing was conducted in air plus 5% water vapor at 1177° C., 1200° C., 1250° C. and 1300° C. for various times up to 1,000 hours. The data are presented in Table 7 and plotted in the graphs presented in FIGS. 1–3. One composition was selected for expensive cyclic oxidation testing at 1200° C. in laboratory air using a cycle of two hours at temperature followed by a 10-minute cool to room temperature. This test was run for 250 cycles (500 hours at temperature in conjunction with competitive commercial and experimental alloys). The results of this test are shown in FIG. 4.

Nitridation testing was conducted using an inlet atmosphere of $N_2$-5%$H_2$ and two test temperatures of 1121 ° C. and 1177° C. These nitridation tests were conducted in electrically heated muffle furnaces having a 100 mm diameter mullite tube with end caps. Samples were placed in cordierite boats and inserted into the end of the furnace tube prior to the start of the test. The tube was purged with argon, then the samples were pushed into the hot zone using a push rod rning through an airtight seal and the nitriding atmosphere turned on. At 100 hour intervals, the steps were reversed and the samples were removed from the furnace for weight measurements. The testing was conducted for 1,000 hours. The results are presented in Table 7 and in FIGS. 5 and 6.

Figure 5:
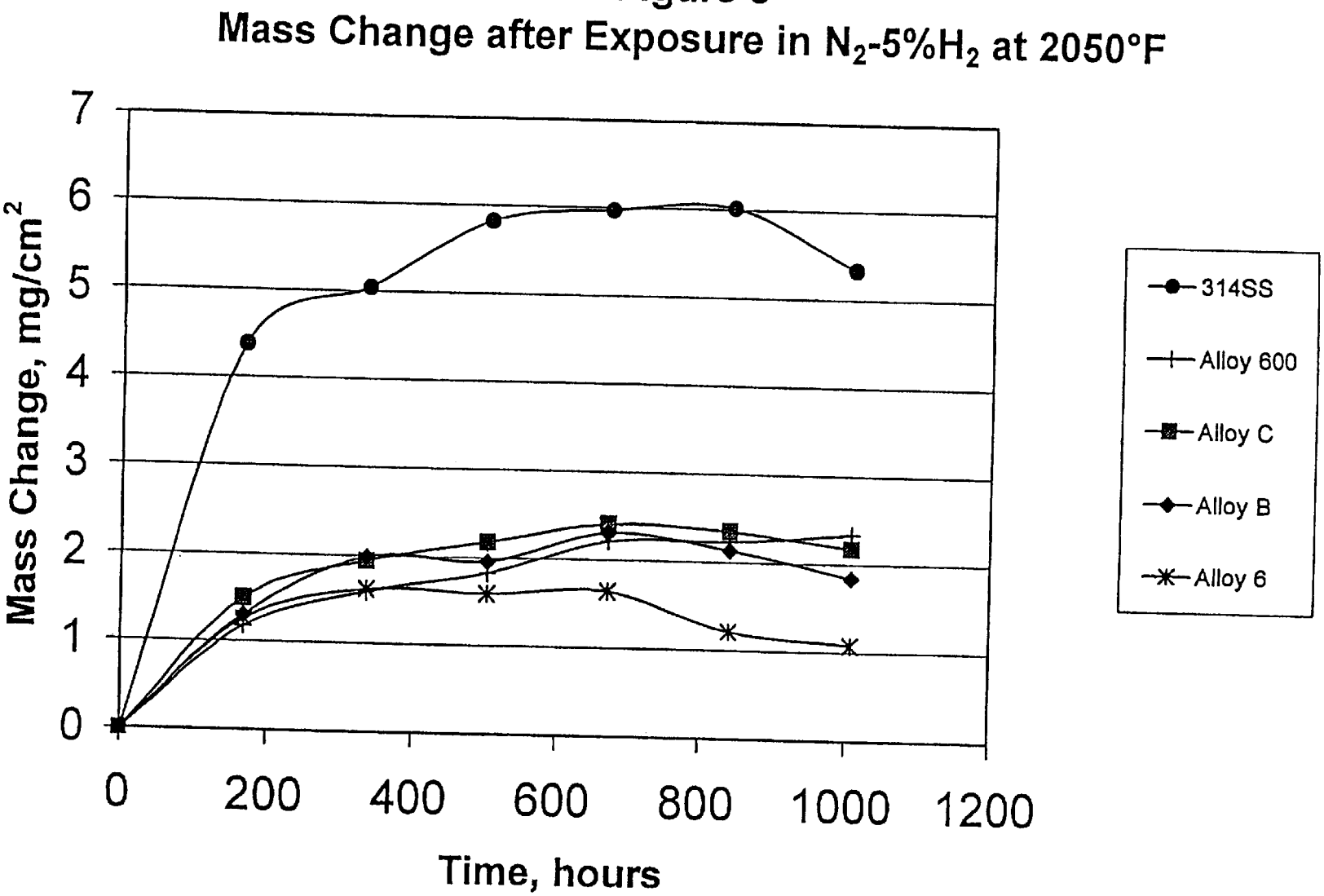
FIG. 5 is a graph plotting mass change after exposure in an $N_2$-5%$H_2$ atmosphere vs. time run on various alloys at 1121° C. (2050° F.)
Figure 6:
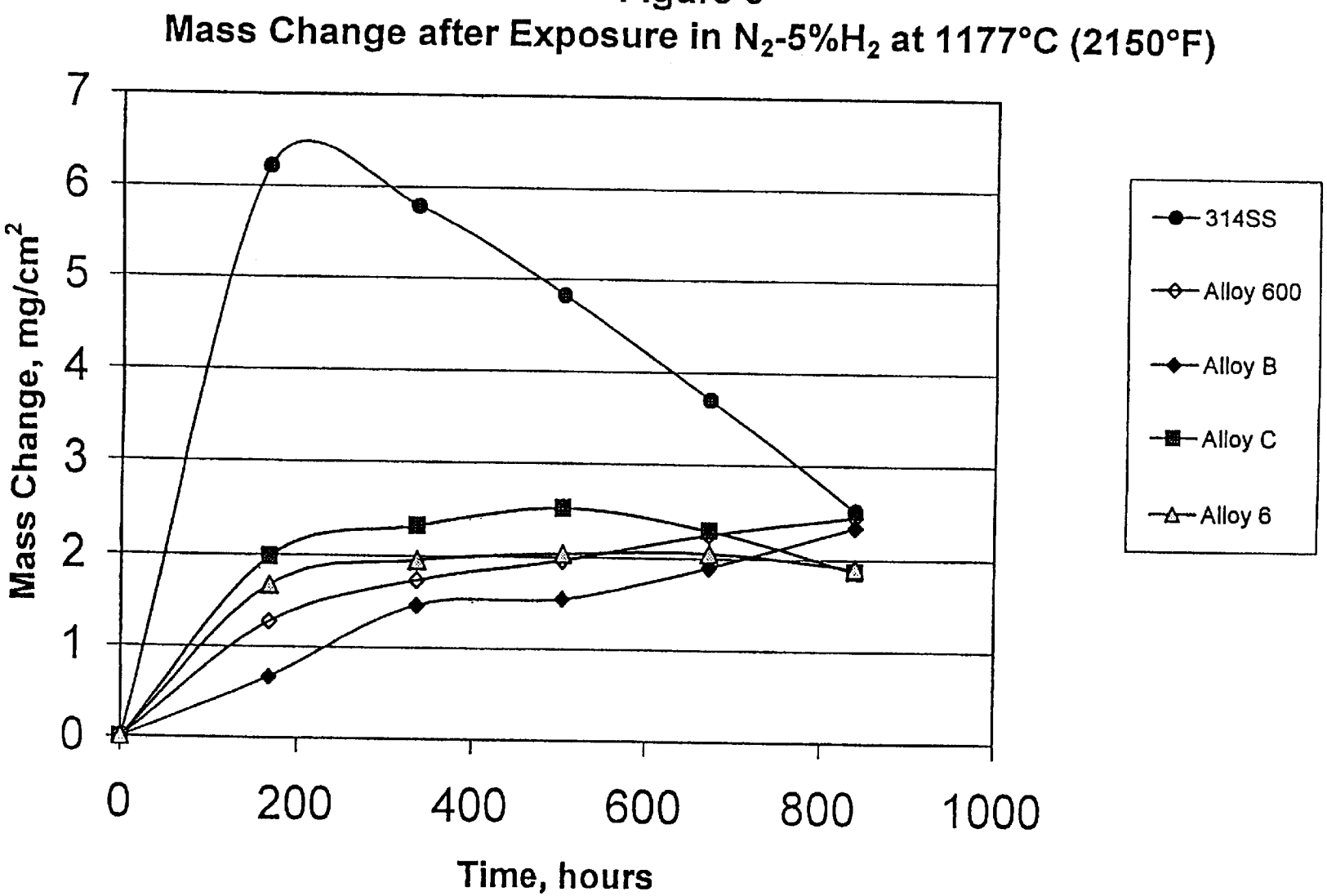
FIG. 6 is a graph similar to FIG. 5 where the test was run at 1177° C. (2150° F.) on the same alloys.

The tensile data of Tables 3 and 4 show the alloy range of this invention to be well suited for the intended applications and certainly competitive with other heat resistant alloys lacking the requisite corrosion resistance and, in some cases, the strength as well. The data on oxidation resistance presented in FIGS. 1–4 depict the exceptional oxidation and spallation resistance the alloys of this invention possess in comparison to that of the competitive commercial alloys. Similarly, FIGS. 5 and 6 show the superior nitridation resistance possessed by the alloy range of this invention.

TABLE 1A

| | Compositions of This Invention (Weight Percent) | | | | | |
|---|---|---|---|---|---|---|
| Element | Alloy 1 | Alloy 2 | Alloy 3 | Alloy 4 | Alloy 5 | Alloy 6 |
| Cr | 15.19 | 15.20 | 15.23 | 15.30 | 15.02 | 21.88 |
| Si | 0.79 | 0/81 | 0.81 | 0.80 | 0.83 | 1.37 |
| Mo | <0.01 | <0.01 | <0.01 | <0.01 | <0.01 | 2.97 |
| Nb | 0.98 | 0.99 | 0.94 | 0.91 | 1.96 | <0.01 |
| Fe | 2.17 | 2.06 | 2.01 | 2.02 | 2.14 | 0.12 |
| Ti | 0.43 | 0.42 | 0.43 | 0.43 | 0.27 | <0.01 |
| Al | 0.30 | 0.29 | 0.30 | 0.31 | 0.29 | 0.02 |
| Mn | <0.01 | <0.01 | <0.01 | <0.01 | <0.01 | <0.01 |
| Zr | 0.08 | 0.06 | 0.07 | 0.07 | 0.07 | <0.01 |
| Ce | — | — | — | — | — | ~0.06 |
| Mg | 0.019 | 0.0112 | 0.0164 | 0.0236 | 0.0128 | 0.019 |
| B | — | — | — | — | — | 0.001 |
| C | 0.045 | 0.087 | 0.134 | 0.212 | 0.013 | 0.006 |
| Co | <0.01 | <0.01 | <0.01 | <0.01 | 19.34 | 0.02 |
| Ni | 79.94 | 80.02 | 80.01 | 79.87 | 59.84 | 74.51 |

TABLE 1B

| | Compositions of This Invention (Weight Percent) | | | | | |
|---|---|---|---|---|---|---|
| Element | Alloy 7 | Alloy 8 | Alloy 9 | Alloy 10 | Alloy 11 | Alloy 12 |
| Cr | 15.61 | 15.65 | 15.64 | 15.57 | 15.52 | 15.60 |
| Si | 1.00 | 1.34 | 1.96 | 2.00 | 0.97 | 1.91 |
| Mo | <0.01 | <0.01 | <0.01 | <0.01 | <0.01 | <0.01 |
| Nb | 0.01 | 0.01 | 0.01 | 0.50 | 0.98 | 0.99 |
| Fe | 2.06 | 2.07 | 2.06 | 2.06 | 2.05 | 2.06 |
| Ti | 0.44 | 0.44 | 0.44 | 0.43 | 0.43 | 0.42 |
| Al | 0.25 | 0.25 | 0.26 | 0.29 | 0.26 | 0.27 |
| Mn | <0.01 | <0.01 | <0.01 | <0.01 | <0.01 | <0.01 |
| Zr | 0.03 | 0.03 | 0.03 | 0.03 | 0.03 | 0.03 |
| Ce | — | — | — | — | — | — |
| Mg | 0.020 | 0.024 | 0.026 | 0.020 | 0.020 | 0.020 |
| B | 0.003 | 0.003 | 0.003 | 0.003 | 0.003 | 0.003 |
| C | 0.014 | 0.015 | 0.015 | 0.020 | 0.010 | 0.010 |
| Co | <0.01 | <0.01 | <0.01 | <0.01 | <0.01 | <0.01 |
| Ni | 80.55 | 80.15 | 79.55 | 79.05 | 79.70 | 78.66 |

TABLE 2A

| | Comparative Commercial Alloy Compositions (Weight Percent) | | | | | |
|---|---|---|---|---|---|---|
| Element | 310 SS | 314 SS | Alloy 600 | Alloy HX | Alloy B | Alloy C |
| Cr | 25.0 | 24.5 | 16.35 | 21.01 | 14.92 | 23.96 |
| Si | 0.70 | 2.03 | 0.14 | 0.32 | 1.27 | 1.36 |
| Mo | — | — | 0.19 | 8.47 | <0.01 | <0.01 |
| Nb | — | — | 0.04 | 0.03 | <0.01 | <0.01 |
| Fe | Bal | Bal | 8.75 | 17.71 | 0.06 | 0.09 |
| Ti | — | 0.02 | 0.22 | 0.02 | <0.01 | <0.01 |
| Al | — | 0.04 | 0.24 | 0.20 | <0.01 | <0.01 |
| Mn | ~2.0 | 1.25 | 0.21 | 0.50 | <0.01 | <0.01 |
| Zr | — | — | — | — | — | — |
| Ce | — | — | — | — | ~0.06 | ~0.06 |
| Mg | — | — | 0.03 | 0.007 | 0.047 | 0.037 |
| B | — | — | — | — | — | — |
| C | ~0.15 | 0.19 | 0.03 | 0.06 | 0.006 | 0.008 |
| Co | — | — | 0.07 | 1.53 | <0.01 | <0.01 |
| Ni | 20.0 | 20.5 | 74.7 | 50.1 | 83.4 | 74.3 |

TABLE 2B

| | Comparative Commercial Alloy Compositions (Weight Percent) | | | |
|---|---|---|---|---|
| Element | Alloy 800 | Alloy 520 | Alloy DS | Alloy 330 |
| Cr | 21.4 | 21.0 | 18.0 | 19.2 |
| Si | 0.35 | 2.0 | 2.20 | 1.29 |
| Nb | — | 1.0 | — | — |
| Fe | Bal | Bal | Bal | Bal |
| Ti | 0.44 | NA* | D0.05 | 0.03 |
| Al | 0.35 | NA* | D0.1 | 0.01 |
| Mn | 0.79 | NA* | 1.3 | 1.75 |
| C | 0.04 | NA* | 0.03 | 0.06 |
| Ni | 31.8 | 35.0 | 34.3 | 34.8 |

*NA = Not Analyzed

TABLE 3

Room and Selected Elevated Temperature Tensile Properties
Compositions of This invention

| | Room Temperature Tensile Properties | | | 1150° C. Tensile Properties | | |
|---|---|---|---|---|---|---|
| Alloy | 0.2% Yield Strength (MPa) | Ultimate Tenisle Stength (MPa) | Elongation (%) | 0.2% Yield Stength (MPa) | Ultimate Tensile Strength (MPa) | Elongation (%) |
| 1 | 228 | 680 | 55 | 17.0 | 35.0 | 88 |
| 2 | 252 | 721 | 49 | 19.1 | 36.0 | 88 |
| 3 | 248 | 715 | 52 | 20.0 | 38.0 | 118 |
| 4 | 283 | 755 | 47 | 22.0 | 39.0 | 88.0 |
| 5 | 273 | 777 | 44 | 18.0 | 41.6 | 85 |
| 6 | 278 | 691 | 62 | — | — | — |
| | | | | 1100° C. Tensile Properties | | |
| 7 | 183 | 575 | 38 | 18.6 | 39.3 | 123 |
| 8 | 192 | 579 | 58 | 19.3 | 37.9 | 151 |
| 9 | 211 | 596 | 53 | 28.3 | 41.4 | 114 |
| 10 | 208 | 610 | 62 | 19.3 | 38.6 | 123 |
| 11 | 197 | 607 | 64 | 22.1 | 42.1 | 163 |
| 12 | 197 | 620 | 63 | 19.3 | 40.7 | 189 |

TABLE 4

Selected Elevated Temperature Tensile Properties
Compositions of This Invention

| | 1177° C. Tensile Properties | | | 1200° C. Tensile Properties | | |
|---|---|---|---|---|---|---|
| Alloy | 0.2% Yield Strength (MPa) | Ultimate Tensile Strength (MPa) | Elongation (%) | 0.2% Yield Strength (MPa) | Ultimate Tensile Strength (MPa) | Elongation (%) |
| 1 | 9.0 | 30.0 | 90 | 9.0 | 26.0 | 91 |
| 2 | 14.0 | 30.0 | 72 | 12.0 | 26.8 | 92 |
| 3 | 14.0 | 31.0 | 125 | 14.0 | 26.0 | 157 |
| 4 | 15.0 | 33.0 | 99 | 14.0 | Rod Failure | |
| 5 | 17.0 | 37.0 | 85 | 13.0 | 31.0 | — |

TABLE 5

Room Temperature and Selected Elevated Temperature Tensile Properties
Commercial Compositions Used in Thermal Processing

| | Room Temperture Tensile Properties | | | 1150° C. Tensile Properties | | |
|---|---|---|---|---|---|---|
| Alloy | 0.2% Yield Strength (MPa) | Ultimate Tensile Strength (MPa) | Elongation (%) | 0.2% Yield Strength (MPa) | Ultimate Tensile Strength (MPa) | Elongation (%) |
| 310 SS | 318 | 676 | 50 | — | — | — |
| 314 SS | 240 | 540 | 30 | 19.0* | 28.0* | — |
| Alloy 600 | 270 | 650 | 45 | 11.7 | 22.8 | 105 |
| Alloy HX | 400 | 800 | 45 | — | — | — |
| Alloy B | 333 | 685 | 51 | 25.0 | 35.0 | — |
| Alloy C | 245 | 687 | 55 | 15.0 | 30.0 | 55 |

*Data obtained at 1100° C.

TABLE 6

Effect of Silicon Content Contained in Four Commercial Alloys on Their Nitridation Resistance in Pure Nitrogen at 1100° C. after 960 Hours

| Alloy | Silicon Content | Thickness of Denuded Zone (microns) | Depth of Attack (microns) | Mass Change ($mg/cm^2$) |
|---|---|---|---|---|
| Alloy 800 | 0.35 | 165.1 | To Center | 9.38 |
| Alloy 330 | 1.29 | 190.4 | To Center | 3.30 |
| Alloy 520 | 2.0 | 246.4 | To Center | −22.42 |
| Alloy DS | 2.20 | 152.4 | To Center | −14.77 |

TABLE 7

Oxidation and Nitridation Corrosion Data at 1177° C. for Selected Alloys of This Invention (Oxidation Test Time is 504 Hours-Nitridation Test Time is 2064 Hours)

| Alloy | Mass Change During Oxidation ($mg/cm^2$) | Mass Change During Nitridation ($mg/cm^2$) |
|---|---|---|
| 1 | −76.2 | 3.5 |
| 2 | −67.3 | 2.3 |
| 3 | −44.9 | 2.6 |
| 4 | −52.3 | 2.5 |
| 5 | — | 2.6 |

We claim:

1. A high strength, high temperature, corrosion resistant alloy composition consisting essentially of in % by weight about:

15.0–23.0% Cr, 0.5–2.0% Si, 0.0–4.0% Mo, 0.0–1.2% Nb, 0.0–3.0% Fe, 0.0–0.5% Ti, 0.0–0.5% Al, 0.0–0.3% Mn, 0.0–0.1% Zr, 0.0–0.06% Ce, 0.005–0.025% Mg, 0.0005–0.005% B, 0.005–0.3% C, 0.0–20.0% Co, (Ni+Co) greater than 72% and including incidental impurities, and wherein the ratio of(Zr+Ce+Mg+Si) to (Mo+Nb+Fe+Ti) is at least 1:16.5.

2. The alloy composition of claim 1, wherein the composition includes about:

21.0–23.0% Cr, 1.3–1.5% Si, 2.5–3.5% Mo, 0.0–0.2% Nb, 0.0–1.0% Fe, 0.0–0.1% Ti, 0.0–0.1% Al, 0.0–0.1% Mn, 0.0–0.1% Zr, 0.015–0.035% Ce, 0.005–0.025% Mg, 0.0005 –0.005% B, 0.005–0.05% C, and (Ni+Co) greater than 75%.

3. Wire mesh belting for use in a powder metallurgy sintering furnace wherein the furnace has a controlled atmosphere of nitrogen and operates at temperatures up to 1200° C. or more, said wire mesh belting made from an alloy consisting essentially of in % by weight about:

15.0–23.0% Cr, 0.5–2.0% Si, 0.0–4.0% Mo, 0.0–1.2% Nb, 0.0–3.0% Fe, 0.0–0.5% Ti, 0.0–0.5% Al, 0.0–0.3% Mn, 0.0–0.1% Zr, 0.0–0.06% Ce, 0.005–0.025% Mg, 0.0005–0.005% B, 0.005–0.3% C, 0.0–20.0% Co, (Ni+Co) greater than 72% and including incidental impurities, and wherein the ratio of (Zr+Ce+Mg+Si) to (Mo+Nb+Fe+Ti) is at least 1:16.5.

4. The wire mesh belting of claim 3 wherein the alloy includes about:

21.0–23.0% Cr, 1.3–1.5% Si, 2.5–3.5% Mo, 0.0–0.2% Nb, 0.0–1.0% Fe, 0.0–0.1% Ti, 0.0–0.1% Al, 0.0–0.1% Mn, 0.0–0.1% Zr, 0.015–0.035% Ce, 0.005–0.025% Mg, 0.0005 –0.005% B, 0.005–0.05% C, and (Ni+Co) greater than 75%.

5. A sheathing tube for a mineral-insulated metal sheathed (MIMS) thermocouple made from an alloy consisting essentially of in % by weight about:

15.0–23.0% Cr, 0.5–2.0% Si, 0.0–4.0% Mo, 0.0–1.2% Nb, 0.0–3.0% Fe, 0.0–0.5% Ti, 0.0–0.5% Al, 0.0–0.3% Mn, 0.0–0.1% Zr, p.0–0.06% Ce, 0.005–0.025% Mg, 0.0005–0.005% B, 0.005–0.3% C, 0.0–20.0% Co, (Ni+Co) greater than 72% and including incidental impurities, and wherein the ratio of (Zr+Ce+Mg+Si) to (Mo+Nb+Fe+Ti) is at least 1:16.5.

6. The sheathing tube of claim 5 wherein the alloy includes about:

21.0–23.0% Cr, 1.3–1.5% Si, 2.5–3.5% Mo, 0.0–0.2% Nb, 0.0–1.0% Fe, 0.0–0.1% Ti, 0.0–0.1% Al, 0.0–0.1% Mn, 0.0–0.1% Zr, 0.015–0.035% Ce, 0.005–0.025% Mg, 0.0005 –0.005% B, 0.005–0.05% C, and (Ni+Co) greater than 75%.

7. A resistance heating element including a heating wire made from an alloy consisting essentially of in % by weight about:

15.0–23.0% Cr, 0.5–2.0% Si, 0.0–4.0% Mo, 0.0–1.2% Nb, 0.0–3.0% Fe, 0.0–0.5% Ti, 0.0–0.5% Al, 0.0–0.3% Mn, 0.0–0.1% Zr, 0.0–0.06% Ce, 0.005–0.025% Mg, 0.0005–0.005% B, 0.005–0.3% C, 0.0–20.0% Co, (Ni+Co) greater than 72% and including incidental impurities, and wherein the ratio of (Zr+Ce+Mg+Si) to (Mo+Nb+Fe+Ti) is at least 1:16.5.

8. The resistance heating element of claim 7 wherein the alloy includes about:

21.0–23.0% Cr, 1.3–1.5% Si, 2.5–3.5% Mo, 0.0–0.2% Nb, 0.0–1.0% Fe, 0.0–0.1% Ti, 0.0–0.1% Al, 0.0–0.1% Mn, 0.0–0.1% Zr, 0.015–0.035% Ce, 0.005–0.025% Mg, 0.0005 –0.005% B, 0.005–0.05% C, balance Ni and incidental impurities.

* * * * *

UNITED STATES PATENT AND TRADEMARK OFFICE

CERTIFICATE OF CORRECTION

PATENT NO. : 6,537,393 B2
DATED : March 25, 2003
INVENTOR(S) : Norman C. Farr et al.

It is certified that error appears in the above-identified patent and that said Letters Patent is hereby corrected as shown below:

Column 10,
Line 18, "p.0-0.06%Ce" should read -- 0.0-0.06% Ce --.

Signed and Sealed this

Twelfth Day of August, 2003

JAMES E. ROGAN
*Director of the United States Patent and Trademark Office*